US005641005A

United States Patent [19]

Kountz et al.

[11] Patent Number: 5,641,005

[45] Date of Patent: Jun. 24, 1997

[54] SYSTEM AND METHOD FOR CHARGING A CONTAINER WITH PRESSURIZED GAS

[75] Inventors: Kenneth J. Kountz, Palatine; Christopher F. Blazek, Palos Hills, both of Ill.

[73] Assignee: Gas Research Institute, Chicago, Ill.

[21] Appl. No.: 349,484

[22] Filed: Dec. 2, 1994

[51] Int. Cl.[6] ..... B65B 1/30; B65B 3/26

[52] U.S. Cl. ..... 141/83; 141/3; 141/4; 141/5; 141/18; 141/21; 141/39; 141/82; 141/95; 165/160

[58] Field of Search ..... 141/2–5, 18, 21, 141/37, 39, 40, 82, 83, 95, 11, 192, 197; 165/159, 160; 48/190; 222/146.6

[56] References Cited

U.S. PATENT DOCUMENTS

| | | | |
|---|---|---|---|
| 2,663,626 | 12/1953 | Spangler | 48/190 |
| 3,762,447 | 10/1973 | Holland | 138/113 |
| 4,493,368 | 1/1985 | Gronnerud et al. | 165/159 |
| 4,531,558 | 7/1985 | Engel et al. | 141/82 |
| 4,643,249 | 2/1987 | Grawey | 165/159 |
| 4,834,173 | 5/1989 | Weiss et al. | 165/159 |
| 5,107,906 | 4/1992 | Swenson et al. | 141/11 |
| 5,121,609 | 6/1992 | Cieslukowski | 62/50.4 |
| 5,127,230 | 7/1992 | Neeser et al. | 62/7 |
| 5,228,295 | 7/1993 | Gustafson | 62/7 |
| 5,231,838 | 8/1993 | Cieslukowski | 62/50.4 |
| 5,315,831 | 5/1994 | Goode et al. | 62/7 |
| 5,325,894 | 7/1994 | Kooy et al. | 141/4 |
| 5,373,702 | 12/1994 | Kalet et al. | 141/4 |
| 5,479,966 | 1/1996 | Tison et al. | 141/4 |

*Primary Examiner*—Henry J. Recla
*Assistant Examiner*—Timothy L. Maust
*Attorney, Agent, or Firm*—Speckman, Pauley & Fejer

[57] ABSTRACT

A method and system for charging a container with a pressurized gaseous fuel. The gaseous fuel is transferred from a gas supply through a heat exchanger to a fueling dispenser. The gaseous fuel is cooled as a function of one or both of a fueling station pressure availability or a container pressure rating. This method and system ensure that a pressurized gas cylinder can be completely charged regardless of the ambient temperature.

12 Claims, 4 Drawing Sheets

SYSTEM AND METHOD FOR CHARGING A CONTAINER WITH PRESSURIZED GAS

BACKGROUND OF THE INVENTION

1. Field of the Invention

This invention relates to a method and system for charging a container with pressurized gaseous fuel.

2. Description of Prior Art

Extending the driving range of natural gas vehicles is important for wide-spread acceptance of natural gas vehicles among consumers as a favorable environmental alternative to gasoline and diesel vehicles.

One obstacle to obtaining the maximum usable capacity of a natural gas vehicle (NGV) cylinder is the increased internal cylinder pressure necessary to completely charge a NGV cylinder in relatively warm ambient temperatures. Because there is a direct relationship between the internal pressure and the internal temperature in a constant volume cylinder for a given mass of gas, the higher the temperature of the gas, the greater the supply pressure necessary to charge the cylinder with a given mass of gas. A NGV cylinder often reaches its maximum internal design pressure before being fully charged, particularly in such relatively warm temperature conditions.

U.S. Pat. Nos. 5,121,609, 5,228,295, and 5,231,838 generally teach fueling systems for delivering liquid natural gas and compressed natural gas to natural gas vehicles.

U.S. Pat. No. 5,315,831 teaches a fueling system that delivers liquid natural gas and compressed natural gas to natural gas vehicles, the compressed gas being generated by heating liquid natural gas.

U.S. Pat. No. 5,107,906 teaches a fueling system for fast-filling a natural gas vehicle cylinder, also by heating a supply of liquid natural gas.

None of the above-mentioned patents teach a system or method for ensuring a complete charge of a natural gas cylinder in relatively warm ambient temperatures. Thus, it is apparent that there is a need for a natural gas fueling station that can completely fast-fill a natural gas cylinder, regardless of the ambient temperature.

SUMMARY OF THE INVENTION

It is an object of this invention to provide a method and system for ensuring a complete and fast-fill of a pressurized container, such as a natural gas vehicle (NGV) cylinder, with a fuel, such as natural gas, regardless of the ambient temperature.

It is another object of this invention to provide a method and system for charging a container with a pressurized gas so that a pressurized container can be completely fast-filled without exceeding the maximum pressure rating of the container.

It is another object of this invention to provide a method and system for achieving maximum driving distances between refuelings for natural gas vehicles, even in relatively warm ambient temperatures.

It is yet another object of this invention to provide a method and system for determining a preferable combination of gas temperature and internal cylinder pressure when fast-filling a NGV cylinder.

It is still another object of this invention to provide a method and system that enables the use of lower supply or fueling station pressures when fast-filling a pressurized container.

The above-mentioned and other objects of this invention are achieved with a pressurized gas that passes through a heat exchanger and eventually reaches one or more fueling dispensers. A controller, such as a programmed logic controller, preferably detects a user initiating the charging process. The controller targets a gas temperature based upon an input of a supply pressure available at a fueling station and/or a pressure rating of the pressurized cylinder. The controller determines if a current gas temperature at a fueling dispenser is equal to or below the targeted gas temperature, and as necessary, initiates heat transfer to the gaseous fuel so that it reaches the fueling dispenser at, or below, the targeted temperature, thus enabling a complete and fast-fill of the cylinder. A fast-fill for a natural gas vehicle (NGV) cylinder, for example, is typically understood to be a pressurized container charging process that completes in under approximately five minutes. Because of a direct relationship between the internal pressure and the internal temperature in a constant volume container for a given mass of gas, as the temperature inside the container increases, the pressure inside the container also increases. Undercharging NGV cylinders is a result of the elevated temperature which occurs inside the NGV cylinder, due to gas compression and other thermodynamic processes, during the complex cylinder charging process.

In one preferred embodiment of this invention, a cooling mechanism for accomplishing the heat transfer includes a heat exchanger, a coolant pump, and a coolant chiller system. The coolant pump receives a signal emitted by the controller, and can vary the flow conditions of the coolant flowing through the heat exchanger as necessary to cool the gaseous fuel as it is transferred through the heat exchanger and to the fueling dispenser. The coolant chiller system preferably maintains a constant supply of chilled coolant, including an excess for peak demand situations.

BRIEF DESCRIPTION OF THE DRAWINGS

These and other objects and features of this invention will be better understood from the following detailed description taken in conjunction with the drawings wherein.

DESCRIPTION OF PREFERRED EMBODIMENTS

Figure 1:
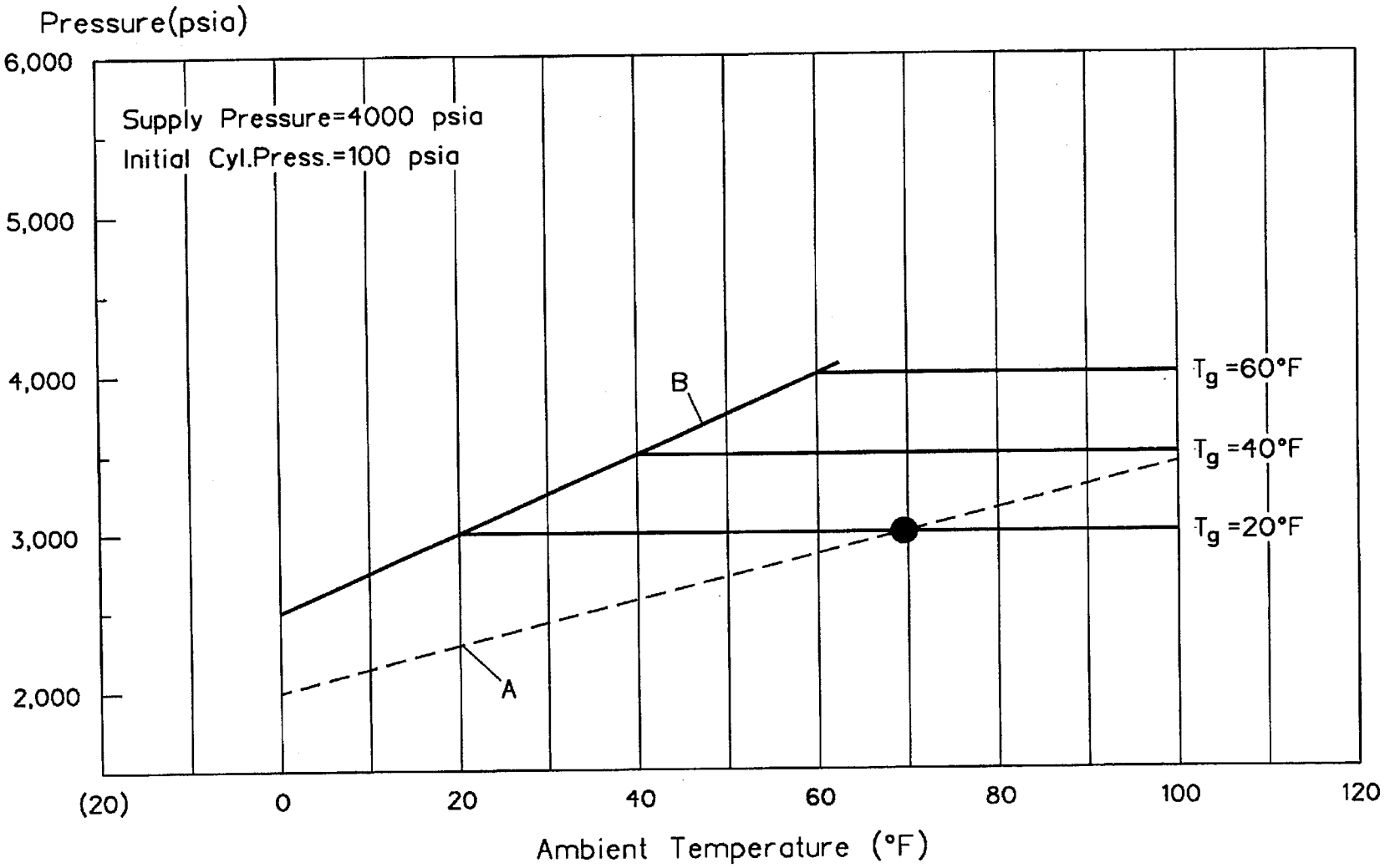
FIG. 1 shows a graph reflecting the charging pressure required to completely fill a cylinder given an initial supply gas temperature, at a supply pressure of approximately 4000 pounds per square inch absolute (psia)

Referring to the graph shown in FIG. 1, the relationship between the temperature of the gas, and the pressure necessary for a complete fill of a container can be understood. Line A is based on analytical data, and is more fully described below. Line B is based on data derived from extensive modelling and well instrumented experiments of various cylinder charging processes, and is also more fully described below. In a preferred embodiment of this invention, cylinder 20 can be a conventional fuel container designed for installation in a natural gas vehicle (NGV). In the graph shown in FIG. 1, the initial pressure inside cylinder 20 is assumed to be 100 pounds per square inch, absolute (psia), which essentially corresponds to an empty or to-be-filled cylinder 20. The y-axis of the graph shown in FIG. 1, labelled Pressure, psia, represents the internal pressure of cylinder 20. The x-axis of the graph shown in FIG. 1, labelled Temperature, °F. represents a temperature of the gas, and will be more fully described below.

Line A on the graph shown in FIG. 1, represents the pressure and temperature conditions inside a fully-charged cylinder 20, after cylinder 20 has been exposed to the ambient temperature for a time period sufficient for the temperature inside cylinder 20 to approximately equal the ambient temperature. The point on Line A labelled Rating Point indicates that Line A is based on a cylinder pressure-rated at 3000 psia at a steady-state, or ambient temperature of 70° F. The reference to a complete fill of cylinder 20, throughout this specification, relates to filling cylinder 20 to a sufficient pressure so that after completing the charging process, and allowing temperature of the gas inside cylinder 20 to approximately reach ambient temperature, the internal pressure and internal temperature of gas inside cylinder 20 will correspond to a point on Line A at such ambient temperature. Line A will be hereinafter referred to as the Full Cylinder line. The relationship between temperature and pressure in a constant volume container is such that, for a given mass of gas, as the internal temperature rises, the internal pressure increases. Each point on the Full Cylinder line represents, for a constant mass of gas, a different temperature and pressure that corresponds to a fully-charged cylinder 20.

Line B on the graph shown in FIG. 1 represents the pressures necessary to fully charge cylinder 20 with a gas at corresponding gas charging temperatures. Line B will be hereinafter referred to as the Required Charge line. The Required Charge line accounts for the increase in temperature that occurs in cylinder 20 during the thermodynamically complex cylinder pressurization process, and includes the influence of any heat transfer which may occur in the fueling station gas supply, in the fuel lines between the fueling station and the fueling dispenser, and in cylinder 20 itself.

The lines on the graph shown in FIG. 1 labelled $T_g$=20° F., $T_g$=40° F., and $T_g$=60° F. represent how cooling the natural gas prior to charging cylinder 20 affects the required charging pressure, and are based upon an analysis of the system that has been verified as being accurate in producing the required cylinder pressures in various changing scenarios, where the temperature of the supply gas has varied from the ambient temperature. These lines will be explained in more detail by the use of examples.

As an example of the use of the graph shown in FIG. 1, assume an ambient temperature and a gas charging temperature of 40° F. To completely fill cylinder 20 using 40° F. natural gas, for example, cylinder 20 must be charged to approximately 3450 psia, which can be determined by locating on the y-axis the intersection of the Required Charge line and the 40° F. point on the x-axis. After cylinder 20 has been exposed to the ambient temperature for a period of time sufficient for the temperature of the gas inside cylinder 20 to approximately reach the ambient temperature, 40° F., the pressure in cylinder 20 will be approximately 2600 psia, which can be determined by locating on the y-axis the intersection of the Full Cylinder line and the 40° F. point on the x-axis.

To illustrate how cooling the gas prior to charging cylinder 20 affects the pressure needed to charge cylinder 20, assume an ambient temperature of 40° F., and a gas charging temperature of 20° F., as indicated by the $T_g$=20° F. line. Under such conditions, cylinder 20 can be completely fast-filled by charging cylinder 20 to an internal pressure of approximately 2980 psia, as compared to 3450 psia in the example above when the gas charging temperature was 40° F. This can be determined by locating the intersection of the $T_g$=20° F. line and the 40° F. point on the x-axis, at approximately 2980 psia on the y-axis.

As illustrated in the graph shown in FIG. 1, regardless of the ambient temperature, up to approximately 100° F., if the natural gas is first cooled to approximately 20° F., in order to achieve a complete fill, cylinder 20 need only be charged to approximately 2980 psia. However, cooling the gas to 20° F. for ambient temperatures above approximately 69° F., would be unnecessary because immediately after the charging process is complete, the temperature of the gas inside cylinder 20 would be cooler than the ambient temperature. This is shown on the graph in FIG. 1 at the intersection of the $T_g$=20° F. line and the Full Cylinder line. The temperature corresponding to such intersection is approximately 69° F. Thus, for all ambient temperatures above approximately 69° F., the temperature of the gas inside cylinder 20 will be cooler than the ambient temperature immediately after the charging process completes, assuming a gas charging temperature of 20° F. Therefore, after cylinder 20 has been completely charged, heat transfer will occur from the ambient to the gas, and the internal pressure of the gas in cylinder 20 will rise until the gas reaches the ambient temperature.

For another example of the use of the graph shown in FIG. 1, assume an ambient temperature and an initial natural gas charging temperature of 100° F. Completely filling cylinder 20 using 100° F. gas requires an internal gas pressure in cylinder 20 of over 4000 psia, as can be determined by observing that the Required Charge line, which terminates at the maximum pressure value of 4000 psia, corresponds to only 61° F. at this point. However, if the gas charging temperature is 40° F., even if the ambient temperature remains at 100° F., cylinder 20 need only be charged to an internal gas pressure of approximately 3450 psia, as can be determined by locating on the y-axis the intersection of the 100° F. point on the x-axis and the $T_g$= 40° F. line. Thus, cooling the gas prior to the charging process permits the use of lower supply or fueling station available pressures, and a lower pressure rated NGV fuel cylinder 20. Lower required fueling station available pressures may help reduce the cost of building fueling stations, and lower pressure NGV cylinders 20 may be safer for consumer use, and more economical to manufacture.

Figure 2:
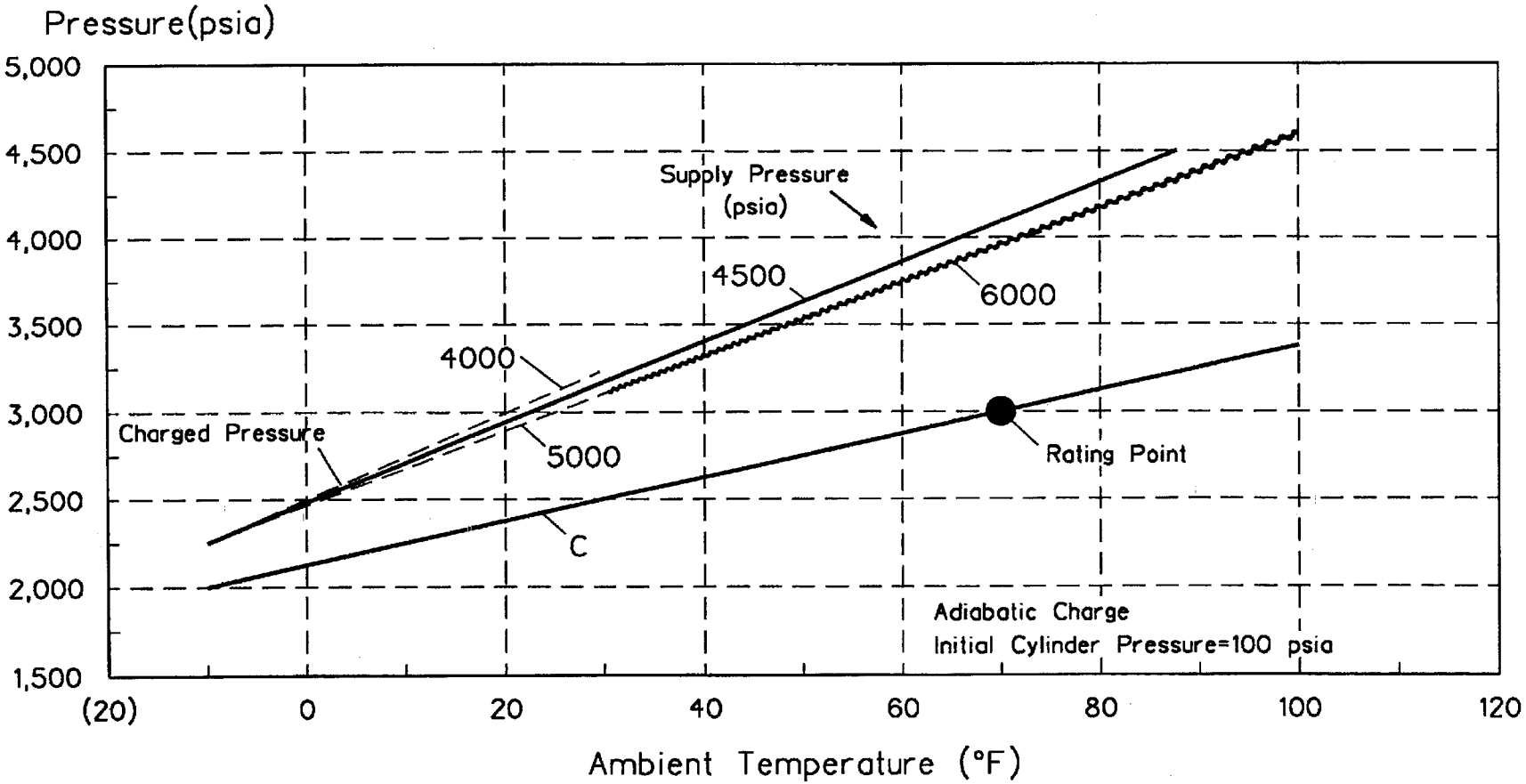
FIG. 2 shows a graph reflecting the charging pressure required to completely fill a cylinder given an initial supply gas temperature, for a family of supply pressures.

The graph shown in FIG. 2 reflects the effect that supply pressure has on the pressure necessary to fully charge NGV cylinder 20 with a gas at a specific gas charging temperature. Line C of the graph shown in FIG. 2 is identical in meaning and in value to Line A of the graph shown in FIG. 1. The family of lines labelled Supply Pressure (psia) in the graph shown in FIG. 2 represent gas supply pressures that range from 4000 psia to 6000 psia in 500 psia increments. Each individual line is identical in meaning to Line B of the graph shown in FIG. 1. The 4000 psia line in the graph shown in FIG. 2 is identical to Line B of the graph shown in FIG. 1. The family of lines of the graph shown in FIG. 2 illustrate that the available supply pressure has a small effect on the gas pressure and gas temperature required to completely fast-fill cylinder 20, due primarily to the Joule-Thomson effect.

Figure 3:
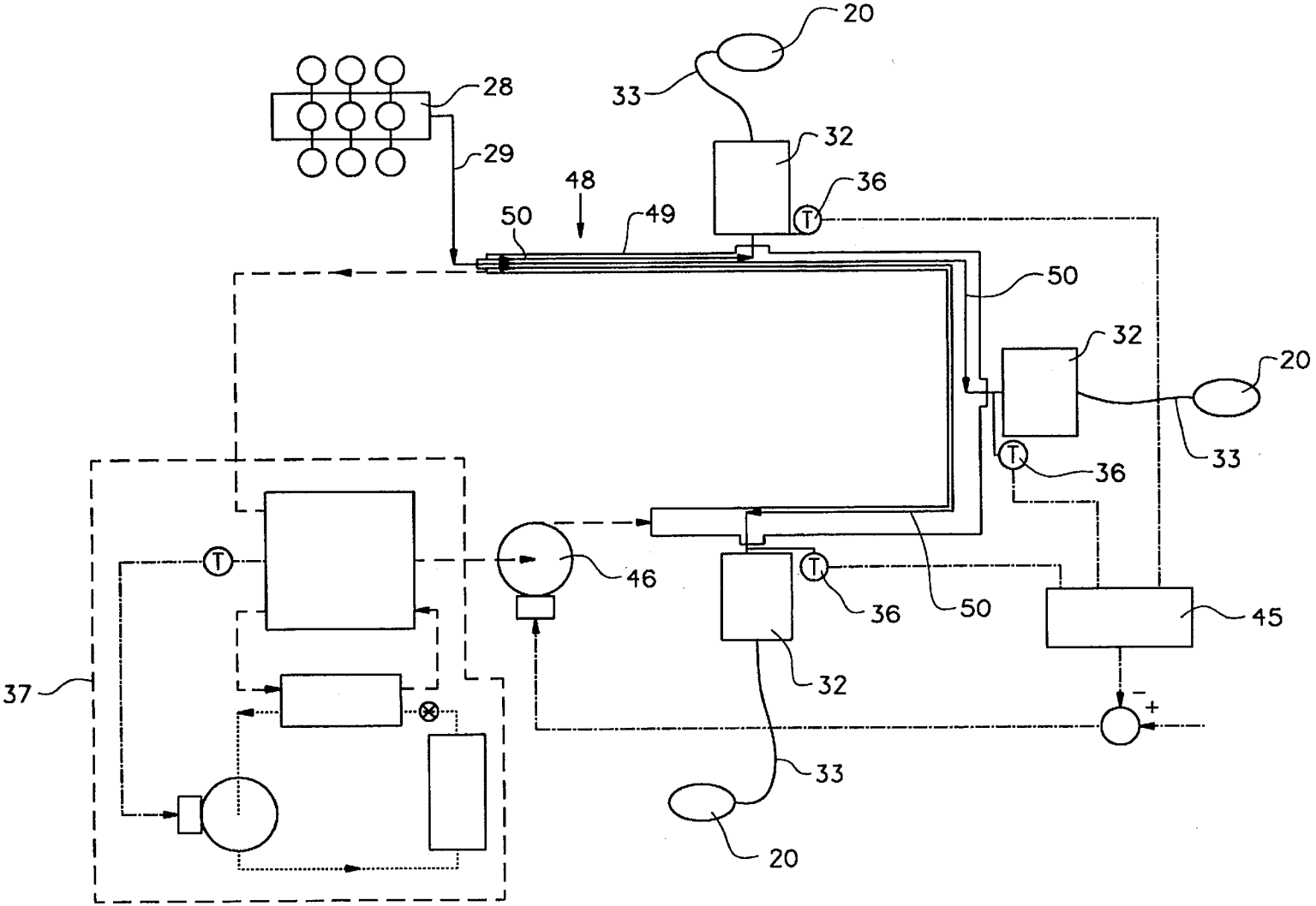
FIG. 3 is a diagrammatic view of a system for charging a container with pressurized gas, according to one embodiment of this invention.

FIG. 3 shows a pressurized container charging system according to one preferred embodiment of this invention.

Gas supply 28 provides pressurized gas, such as natural gas, through one or more fuel lines 29. Fuel line 29 preferably passes through heat exchanger 48, and is in communication with fueling dispenser 32. Fueling dispenser 32 preferably provides pressurized gas to cylinder 20 through fueling hose 33.

It is apparent that heat exchange from the gas could be augmented in many ways. For example, according to another preferred embodiment of this invention, heat exchanger 48 is used to initiate heat transfer and fuel lines 29 are placed in-ground to isolate heat exchanger 48 from high ambient temperatures.

In one preferred embodiment of this invention as shown in FIG. 3, the charging system comprises pressurized gas supply 28 and three fueling dispensers 32. It is also apparent that this invention could comprise any suitable number of gas supplies 28 and any suitable number of fueling dispensers 32.

Thermocouple 36 is preferably located near fueling dispenser 32 to detect a temperature of the gas at or near fueling dispenser 32. It is apparent that there are many conventional ways to detect the temperature of a fluid, such as by using thermistors, gas thermometers, or similar apparatuses, that could be used in lieu of thermocouple 36.

Thermocouple 36 is preferably electrically coupled to programmed logic controller (PLC) 45. PLC 45 receives a signal emitted by thermocouple 36 and thus the temperature of the gas at fueling dispenser 32.

PLC 45 emits a signal to coolant pump 46, according to one preferred embodiment of this invention. The flow rate of the coolant discharged from coolant pump 46 can be varied as a function of the necessary heat transfer desired. PLC 45 can independently compute the temperature of the gas at each fueling dispenser 32, and can use the highest temperature value as the basis for emitting a controlling signal to coolant pump 46.

According to another preferred embodiment of this invention, PLC 45 receives or stores the maximum pressure rating of cylinder 20. It is apparent that a value for the maximum pressure rating can be inputted manually, by having a user manually enter the maximum pressure rating data, possibly at or near fueling dispenser 32, or electronically by incorporating readable data communication means on cylinder 20 and fueling dispenser 32, or in any of a variety of other ways known to those skilled in the art. With this information, PLC 45 calculates a preferred gas charging temperature and cylinder charging pressure for each cylinder 20.

Briefly referring again to the graph shown in FIG. 1, for example, if cylinder 20 has a maximum pressure rating of 4000 psia, and the ambient temperature is above approximately 60° F., the gas charging temperature need only be approximately 60° F. to ensure a complete fast-fill of cylinder 20. However, if cylinder 20 has a maximum pressure rating of only 3450 psia, the gas charging temperature would need to be approximately 40° F. to ensure a complete fast-fill without exceeding the maximum pressure rating of cylinder 20. Thus, PLC 45 can determine an optimal and efficient gas charging temperature and cylinder charging pressure as a function of the maximum pressure rating of cylinder 20, the fueling station supply pressure, and the ambient temperature.

In one preferred embodiment according to this invention, station chiller 37 is in communication with coolant pump 46 and supplies coolant pump 46 with chilled coolant. In another preferred embodiment of this invention, station chiller 37 also maintains an excess cooling capacity for peak periods when fueling dispensers 32 operate simultaneously.

Figure 4:
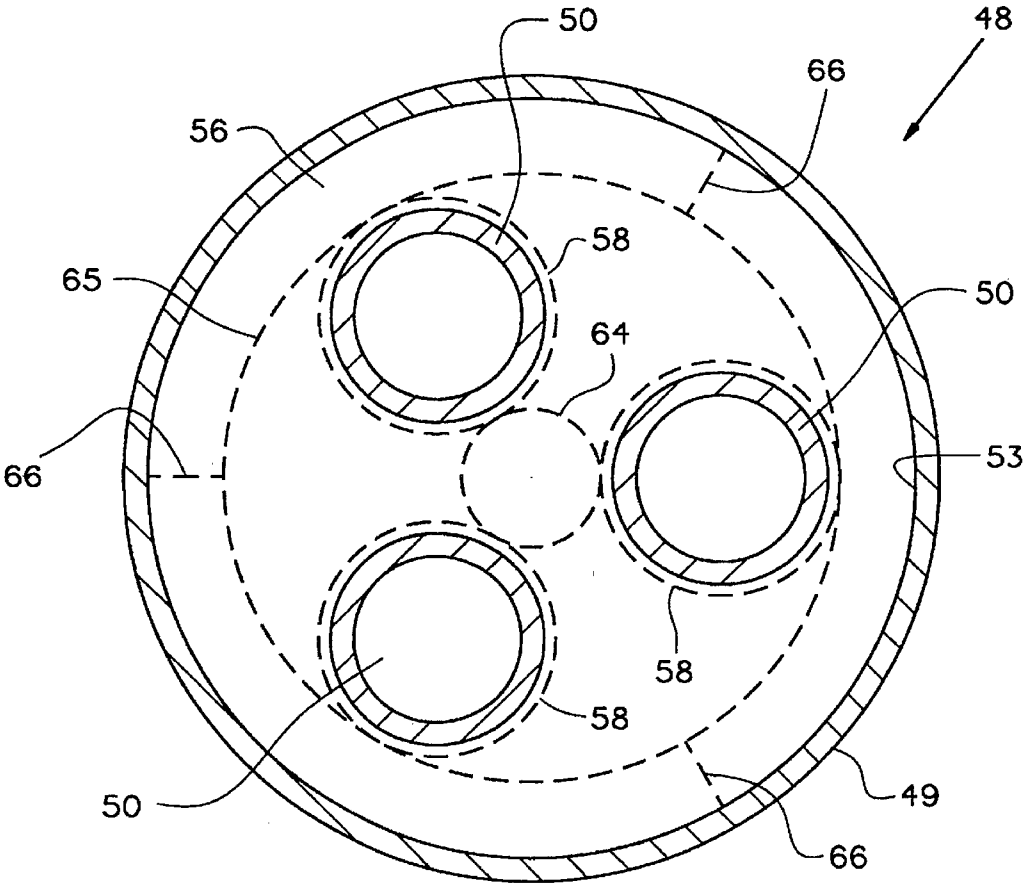
FIG. 4 shows a diagrammatic cross-sectional view of a heat exchanger, according to one preferred embodiment of this invention.

FIG. 4 shows a diagrammatic cross-sectional view of heat exchanger 48 according to one preferred embodiment of this invention. Inner conduits 50, through which the gas flows, are positioned within outer conduit 49. Coolant flows in heat exchanger 48 through the gaps between inner conduits 50 and inner surface 53 of outer conduit 49. Sleeve 58 surrounds each gas carrying inner conduit 50. In one preferred embodiment of this invention, sleeve 58 is rigid and porous and thereby maintains a distance between multiple inner conduits 50, and yet allows coolant to flow through the structure of sleeve 58 and contact inner conduits 50 for increased heat transfer.

According to one preferred embodiment, heat exchanger 48 comprises three inner conduits 50. Each inner conduit 50 can be assigned to one fueling dispenser 32, as shown in FIG. 3. Conduit separating ring 64 is preferably axially aligned with outer conduit 49. Conduit separating ring 64 is preferably rigid enough to maintain inner conduits 50 separated with respect to each other in order to increase heat transfer efficiency, and can also be porous. Inner conduits 50 and sleeves 58 are approximately equally positioned about conduit separating ring 64, as shown in FIG. 3. Conduit enclosing ring 65 is also preferably axially aligned with conduit separating ring 64 and outer conduit 49, and closely surrounds inner conduits 50, urging inner conduits 50 toward separating ring 64. The interaction between conduit enclosing ring 65 and conduit separating ring 64 maintains inner conduits 50 in a fixed and approximately equidistant position with respect to each other, thereby increasing coolant flow and thus heat transfer between inner conduits 50 and the coolant.

It is apparent that heat exchanger 48 can comprise more or less than three inner conduits 50. It is also apparent that more than one fueling dispenser 32 can be assigned to each inner conduit 50.

Positioning means, such as ring supports 66, are used to space conduit enclosing ring 65 from inner surface 53 of outer conduit 49. It is apparent that positioning means could be an annular wall, or a plurality of separate supports.

EXAMPLE 1

Calculations have shown that three inner conduits 50, each comprising ¾ inch stainless steel tubing having an internal diameter of approximately 0.584 inches, when arranged in an embodiment of this invention comprising three fueling dispensers 32, and positioned within a 31 foot long outer conduit 49 of heat exchanger 48, can supply to each fueling dispenser 32 gas cooled from an initial temperature of 100° F. to a charging temperature of 40° F., in sufficient volume to fast-fill, in approximately 2 minutes, a typical NGV cylinder of 1000 standard cubic feet rated capacity. This example assumes the coolant comprises a 50%/50% by volume ethylene glycol/water mixture. An internal diameter of outer conduit 49 of approximately 2 inches would result in an approximate 41 pounds per square inch water side pressure drop, requiring coolant pump 46 to have approximately a ⅓ horse power motor rating. The computed cooling capacity needed in heat exchanger 48 has been determined to be approximately 5.5 tons for each inner conduit 50.

It is apparent that there could be many different suitable embodiments of station chiller 37. For example, station chiller 37 could be of a vapor compression type, station chiller 37 could be a natural gas direct fired absorption cycle type, or station chiller 37 could be of any other suitable design apparent to those skilled in the art. If an absorption cycle type station chiller 37 is used, the temperature of the coolant could be detected and the firing rate of the system burner could be varied as a function of such detected temperature.

If a vapor compression type station chiller 37 is used, and is driven by a constant speed electric motor, the electric motor could be cycled on and off as a function of a detected temperature of the coolant. If an inverter driven electric motor is used to drive a vapor compression type station chiller 37, the speed of the motor could be controlled as a function of the detected coolant temperature. Similarly, if a natural gas engine is used to drive a vapor compression type station chiller 37, the speed of the engine could be controlled as a function of the detected coolant temperature.

An example for calculating an average demand and a peak demand on station chiller 37, according to one embodiment of this invention, is set forth below as Example 2.

EXAMPLE 2

For this example, the following parameters are given:

1) The ambient temperature is 100° F.
2) The gas charging temperature is 40° F.
3) The temperature of the gas at pressurized gas supply 28 is equivalent to the ambient temperature of 100° F.
4) Heat exchanger 48 is equivalent to the heat exchanger 48 as set forth above in Example 1.
5) The fueling station comprises three fueling dispensers 32.
6) Each fueling dispenser 32 services a NGV cylinder 20 every six minutes (approximately two minutes to charge the cylinder and approximately four minutes to pay for the fuel, clean the windshield, etc.).
7) The coolant comprises a 50%/50% by volume ethylene glycol/water mixture.
8) The required load per fueling dispenser 32 is equivalent to the cooling capacity per gas inner conduit 50, 5.5 tons per fueling dispenser 32, as set forth above in Example 1.

A formula used to calculate the approximate average demand on station chiller 37 is:

(Average demand in tons)=(Number of fueling dispensers) * (Fast fill period / Cycle period) * (Required load per fueling dispenser).

Using the values given above:

(Average demand in tons)=3 * (⅔) * (5.5)

(Average demand in tons)=5.5 tons

Therefore, if each fueling dispenser 32 was simultaneously charging a cylinder 20, the instantaneous demand would by 3 * 5.5 tons, or 16.5 tons and a 5.5 ton station chiller 37 could not supply the necessary coolant. To overcome this problem, without requiring a 16.5 ton station chiller 37, a cooled storage of coolant could be utilized. The cool storage requirement can be determined by the following formula:

Cool storage in ton-minutes=(Number of fueling dispensers) * (Required load per fueling dispenser−Average demand per dispenser) * (Fast-fill period)

Using the values given and calculated above:

Cool storage in ton-minutes=3*(5.5-((⅔) * 5.5))*2

Cool storage in ton-minutes=22 ton-minutes

Thus, the cool storage must be capable of supplying 22 ton-minutes of dynamic loading according to this example. If the temperature of the coolant can vary 2.5° F. from a nominal 25° F. temperature during this dynamic period, about 210 gallons of storage volume for the ethylene/glycol mixture would be required.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

We claim:

1. A method for charging a container with a pressurized gaseous fuel, the method comprising:

transferring said pressurized gaseous fuel to a fueling dispenser;

detecting a current gas temperature of said pressurized gaseous fuel at said fueling dispenser;

calculating an estimated temperature of said pressurized gaseous fuel within the container from a set of theoretical data that accounts for a temperature increase within the container during charging due to a Joule-Thomson effect; and cooling said pressurized gaseous fuel as a function of said detected current gas temperature, said estimated temperature and at least one of a supply pressure and a container pressure.

2. A method according to claim 1, wherein said pressurized gaseous fuel is cooled by:

transferring said pressurized gaseous fuel through a heat exchanger; and controlling a flow parameter of a coolant flowing through said heat exchanger.

3. A method according to claim 2, wherein said flow parameter of said coolant is controlled by:

determining a lesser value of a supply pressure value and a container pressure value;

calculating a flow value based upon said lesser value and said current gas temperature; and emitting a signal to a coolant control means as a function of said flow value.

4. A method according to claim 1, wherein said cooling is activated upon a demand for said pressurized gaseous fuel at said fueling dispenser by a user.

5. A system for charging a container with a pressurized gaseous fuel, the system comprising:

transfer means for transferring said pressurized gaseous fuel to a fueling dispenser;

detection means for detecting a current gas temperature of said pressurized gaseous fuel at said fueling dispenser;

calculation means for calculating an estimated temperature of said pressurized gaseous fuel within the container that accounts for a temperature increase of said pressurized gaseous fuel within the container during charging due to a Joule-Thomson effect; and cooling means for cooling said pressurized gaseous fuel as a function of said detected current gas temperature, said estimated temperature and at least one of a supply pressure and a container pressure.

6. A system according to claim 5, wherein said transfer means comprises a pressurized gas supply in communication with said fueling dispenser.

7. A system according to claim 5, wherein said detection means comprises a thermocouple exposed to said pressurized gaseous fuel.

8. A system according to claim 5, wherein said cooling means comprises a heat exchanger through which fuel and coolant passes, said heat exchanger being in communication with said transfer means.

9. A system according to claim 8, wherein said cooling means further comprises a signal processor receiving a first signal from said detection means, and pump means for varying a flow parameter of said coolant flowing through said heat exchanger as a function of a second signal emitted by said signal processor.

10. A system for charging a container with a pressurized gaseous fuel, the system comprising:

transfer means for transferring said pressurized gaseous fuel to a fueling dispenser;

detection means for detecting a current gas temperature of said pressurized gaseous fuel near said fueling dispenser;

cooling means for cooling said pressurized gaseous fuel as a function of said detected temperature and at least one of a supply pressure and a container pressure, said cooling means comprising a heat exchanger through which fuel and coolant passes, said heat exchanger being in communication with said transfer means;

said heat exchanger comprising an outer conduit and at least one inner conduit positioned within said outer conduit; and spacing means for maintaining a distance between an external surface of said at least one inner conduit and a conduit internal surface of said outer conduit.

11. A system according to claim 10, wherein said spacing means comprises:

at least one of said at least one inner conduit positioned within at least one rigid sleeve, and position means for positioning said at least one rigid sleeve at a distance from said internal surface.

12. A system according to claim 11, wherein said position means comprises:

three said inner conduits abutting a ring external surface of a separating ring;

said three inner conduits abutting a ring internal surface of an enclosing ring;

a center axis of each of said conduits approximately equal in distance from a center axis of each adjacent conduit;

ring positioning means for positioning said enclosing ring at a distance from said conduit internal surface.

* * * * *